US007772474B2

(12) United States Patent
Osuga

(10) Patent No.: US 7,772,474 B2
(45) Date of Patent: Aug. 10, 2010

(54) KEYBOARD DEVICE WITH AN ANTI-FLOATING PART FOR ELECTRONIC MUSICAL INSTRUMENT

(75) Inventor: Ichiro Osuga, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 11/888,847

(22) Filed: Aug. 1, 2007

(65) Prior Publication Data

US 2008/0066608 A1 Mar. 20, 2008

(30) Foreign Application Priority Data

Sep. 15, 2006 (JP) ..... 2006-251032
Sep. 15, 2006 (JP) ..... 2006-251033

(51) Int. Cl.
*G10C 3/12* (2006.01)

(52) U.S. Cl. ..... 84/423 R; 84/433; 84/434; 84/174; 84/186.1

(58) Field of Classification Search ..... 84/423 R
See application file for complete search history.

(56) References Cited

U.S. PATENT DOCUMENTS 4,248,130 A * 2/1981 Erickson et al. ..... 84/434
4,351,222 A * 9/1982 Kumano ..... 84/423 R
4,510,839 A * 4/1985 Kumano ..... 84/434
5,079,985 A * 1/1992 Yamaguchi et al. ..... 84/719
5,406,875 A 4/1995 Tamai et al.
5,574,241 A * 11/1996 Kumano et al. ..... 84/439
5,578,782 A * 11/1996 Masubuchi ..... 84/687

FOREIGN PATENT DOCUMENTS

DE 4307566 A1 9/1993
JP 3-100894 U 10/1991
JP 9-198036 7/1997

OTHER PUBLICATIONS

Russian Office Action mailed Nov. 18, 2008, for RU Application No. 2007134450, with English Translation, six pages.

* cited by examiner

*Primary Examiner*—Jeffrey Donels
*Assistant Examiner*—Christopher Uhlir
(74) *Attorney, Agent, or Firm*—Morrison & Foerster LLP

(57) ABSTRACT

A keyboard device is designed for use in an electronic musical instrument. A plurality of keys including white keys and black keys are arranged on a keyboard frame. Supporting parts are mounted on the keyboard frame for supporting the keys pivotably downward and upward. The supporting parts include white key supporting parts to support the white keys and black key supporting parts to support the black keys. The supporting parts are positioned at the rear portions of the keys such that the black key supporting parts are arranged rearward relative to the white key supporting parts. The keyboard frame supports an anti-floating part which extends across the rear portions of the keys and positioned above the supporting parts of the keys so as to prevent the rear portion of the key from floating upward when the front portion of the key is pressed downward.

5 Claims, 9 Drawing Sheets

KEYBOARD DEVICE WITH AN ANTI-FLOATING PART FOR ELECTRONIC MUSICAL INSTRUMENT

BACKGROUND OF THE INVENTION

1. Technical Field of the Invention

The present invention relates to a keyboard device for use in an electronic musical instrument.

In this specification and claims, a proximal portion of an electronic musical instrument and a keyboard device thereof to a performer is defined as a front portion, and a distal portion from the performer is defined as a rear portion.

2. Description of the Related Art

In a keyboard of an acoustic piano, a supporting part of a black key is disposed rearward from a supporting part of a white key. Because the black key is positioned slightly rearward from the white key, shifting the position of the support part of the black key rearward relative to the support part of the white key is advantageous. Namely, a ratio of distances from a key pressing point to the supporting part and from the supporting part to a driving point is made comparative between the white key and the black key, thereby decreasing a difference in touch feelings.

However, in the field of an electronic keyboard instrument, it is important to simplify the structure of the keyboard device. Thus, the key supporting part is commonly mounted without discriminating between the white key and the black key. One exemplary key supporting part is configured to include a recess member for receiving a protrusion provided at a rear end portion of each of the white and black keys to allow the keys to pivot (Patent Reference 1, Japanese Patent Laid-Open Publication No. H9-198036), and another exemplary key supporting part is configured to include an elastic piece which is integrally mounted to the rear end portions of the white and black keys to connect the keys and which is fixed to a keyboard frame (Patent Reference 2, Japanese Utility Model Laid-Open Publication No. H3-100894). The above-structured electronic keyboard instrument has the problems that a difference in touch feelings between the white key and the black key is increased and it is difficult for a performer to perform accurately or express delicately.

SUMMARY OF THE INVENTION

Therefore, the present invention has been made in view of the above problems, and it is an object of the present invention to provide a keyboard device for an electronic musical instrument that is capable of decreasing a difference in touch feelings between a white key and a black key.

In one aspect of the present invention, the above and other objects can be accomplished by the provision of a keyboard device for use in an electronic musical instrument, comprising a keyboard frame, a plurality of keys including white keys and black keys arranged on the keyboard frame, each key having a front portion close to a performer and a rear portion opposite to the front portion, and supporting parts mounted on the keyboard frame for supporting the keys pivotably downward and upward, wherein the supporting parts include white key supporting parts to support the white keys and black key supporting parts to support the black keys, the supporting parts being positioned at the rear portions of the keys such that the black key supporting parts are arranged rearward relative to the white key supporting parts, and wherein the keyboard frame supports an anti-floating part which extends across the rear portions of the white keys and positioned above the white key supporting parts of the white keys so as to prevent the rear portion of the white key from floating upward when the front portion of the white key is pressed downward.

In another aspect of the present invention, the above and other objects can be accomplished by the provision of a keyboard device for use in an electronic musical instrument, comprising a keyboard frame, a plurality of keys including white keys and black keys arranged on the keyboard frame, each key having a front portion close to a performer and a rear portion opposite to the front portion, and supporting parts mounted on the keyboard frame for supporting the keys pivotably downward and upward, wherein the supporting parts include white key supporting parts to support the white keys and black key supporting parts to support the black keys, the supporting parts being positioned at the rear portions of the keys such that the black key supporting parts are arranged rearward relative to the white key supporting parts, and wherein the keyboard frame supports anti-floating parts which extend across the rear portions of the white keys above the white key supporting parts of the white keys and also extends across the rear portions of the block keys above the black key supporting parts of the black keys so as to restrict upward floating of the rear portions of the white keys and the black keys when the front portions of the white keys and the black keys are pressed downward.

According to the keyboard device for use in an electronic musical instrument of the present invention, the supporting parts supporting the keys pivotably upward and downward include white key supporting parts to support the white keys and black key supporting parts to support the black keys. When a proximal portion of the keyboard device to a performer is defined as a front portion, the supporting parts are positioned at rear portions of the keys, and the black key supporting parts are staggered or shifted rearward from the white key supporting parts. In the structure that front ends of the black keys are positioned rearward from the front ends of the white keys, the black key supporting parts are displaced rearward from the white key supporting parts. Accordingly, a difference of rotation radii from the respective supporting points to the respective front ends of the keys between the black keys and the white keys is small, trajectories of finger-contact points of the keys at the front end portions thereof when pressing the keys, are formed similarly between the black keys and the white keys, and a difference of touch feelings between the white keys and the black keys is made small.

Further according to one aspect of the invention, the keyboard frame supports the anti-floating part which extends near an area just above the white key supporting parts over the plurality of keys to prevent rear portions of the white keys from rising off the supporting part or floating upward from the supporting part. In a conventional keyboard device for an electronic musical instrument structured such that a driving portion is mounted near the front end of each key, because an area above the rear portions of the keys are in an opened state without arrangement of a mass body and interlocking members therewith, when a large pressing force is exerted on the front ends of the keys positioned forward from the driving portions, the rear portions of the keys rise and remove away from the supporting parts, and the keys become unstably supported. To cope with this problem, the present invention is provided with the anti-floating part so as to prevent the floating of the rear portions of the keys and to stably support the keys. Specifically, since the anti-floating part is positioned near an area just above the supporting parts of the white keys, although the white keys pivot while contacting the supporting parts, the moving degree of the anti-floating part relative to the white keys is considerably small. Accordingly, resistance, like frictional force, to the pivoting of the white keys can be decreased to very small. Also, since the anti-floating part is positioned near an area just above the supporting parts, although the white keys pivot while being restricted by the anti-floating part, the positions of the supporting parts which are an original pivoting center are maintained, and the positions of the keys in the longitudinal direction are hardly changed. As a result, the operation of the keys are performed stably regardless of whether the rear portions of the keys rise or not, and operational performance of a switch related to the up/down movement of the keys is stabilized.

Further, the anti-floating part is formed to have a width dimension extending over the plurality of keys. Accordingly, the process of mounting the anti-floating part to the keyboard frame and the process of adjusting the position of the anti-floating part relative to the white key supporting parts, can be performed quickly and easily with respect to the whole keys.

Moreover in accordance with another aspect of the invention, the keyboard frame supports the anti-floating parts which are positioned above the rear end portions of both the white keys and the black keys to respectively restrict the rise of the rear portions of the white keys and the rear portions of the black keys. In a conventional keyboard device for an electronic musical instrument structured such that a driving portion is mounted near the front end of each key, because an area above the rear portions of the keys are in an opened state without arrangement of a mass body and interlocking members therewith, when a large pressing force is exerted on the front ends of the keys positioned forward from the driving portions, the rear portions of the keys rise and leave from the supporting parts, and the keys are unstably supported. To cope with this problem, the present invention is provided with the anti-floating parts so as to prevent the rising or floating of both the rear portions of the white and black keys and to stably support the keys.

DETAILED DESCRIPTION OF THE INVENTION

Figure 1:
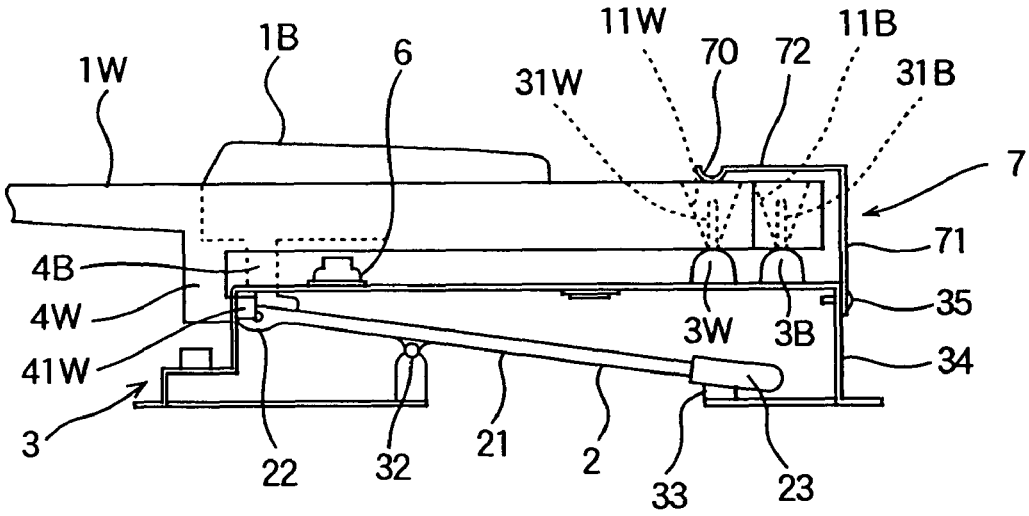
FIG. 1 is a schematic view of essential components of a keyboard device for an electronic musical instrument in accordance with a first embodiment of the present invention.

Various embodiments of the present invention will now be described in detail with reference to the accompanying drawings. The same or like components will be denoted by the same reference numerals throughout the drawings, and the explanation thereof will be omitted.

FIG. 1 shows schematically essential components of a keyboard device for an electronic musical instrument in accordance with a first embodiment of the present invention. The keyboard device is structured such that a plurality of white keys 1W, a plurality of black keys 1B, and a plurality of mass bodies 2 interlocking with the respective keys are supported by a keyboard frame 3.

The rear end portions of the white keys 1W and the black keys 1B are respectively supported by supporting parts 3W and 3B, so that the white keys 1W and the black keys 1B can pivot downward and upward in a vertical direction around the respective supporting parts in response to a touch pressure applied to the front end portion of the keys. The white keys 1W and black keys 1B are respectively provided with driving portions 4W and 4B for the mass bodies at slightly retreated positions from the front ends of the keys. The supporting parts 3W and 3B are provided with pins 31W and 31B which extend upward from the keyboard frame 3. The white keys 1W and the black keys 1B are formed with funnel-shaped holes 11W and 11B, into which the pins are inserted. By the holes 11W and 11B receiving the pins 31W and 31B, the keys are supported pivotably by the supporting parts.

As shown in the drawing, the supporting part 3B of each black key 1B is shifted, deviated or staggered rearward from the supporting part 3W of each white key 1W. Because the front end of the black key is located at a retreated position from the front end of the white key, the positions of the supporting parts 3B and 3W are determined from an aspect of decreasing a difference in rotation radii from key pressing points to the supporting parts between the white key and the black key. To this end, it is preferred that the distance between two supporting parts is set to be 20 to 100% of the distance from the front end of the white key to the front end of the black key.

Because the white key and the black key have the same constitution of the mass body 2, a switch 6 and a touch control sensor, the constitution of the white key will now be described, but the explanation of the constitution of the black key will be omitted. The mass body 2 is rotatably supported by the keyboard frame 3 by a shaft 32 which is coupled to a portion near a front end of a rod 21. The mass body 2 is connected to the driving portion 4W of the white key 1W at a front end portion 22, and is provided with a weight 23 at a rear end portion. In a non-key pressing state, the weight 23 of the mass body 2 is positioned on a stopper 33 of the keyboard frame 3 by its own weight, and the front end portion 22 of the mass body 2 raises the white key 1W to an ascended position. The driving portion 4W of the white key is formed with a hook 41W. The uppermost ascended position of the white key is determined when the hook contacts the keyboard frame 3. The switch 6 is mounted on the keyboard frame 3, just below the white key 1W. When the white key 1W is pressed down, in response to the pressing, the switch 6 transmits a sound generating signal to a control unit (not shown) to generate sound. The switch 6 can be configured as various commonly-used types such as a contact type, a non-contact type, etc. Also, in order for the keyboard device to have a touch control function, the keyboard device may further include a sensor to detect a velocity of the key and a contact pressure when pressing the key. The switch and the sensor may be mounted on the operating position of the mass body.

Figure 2:
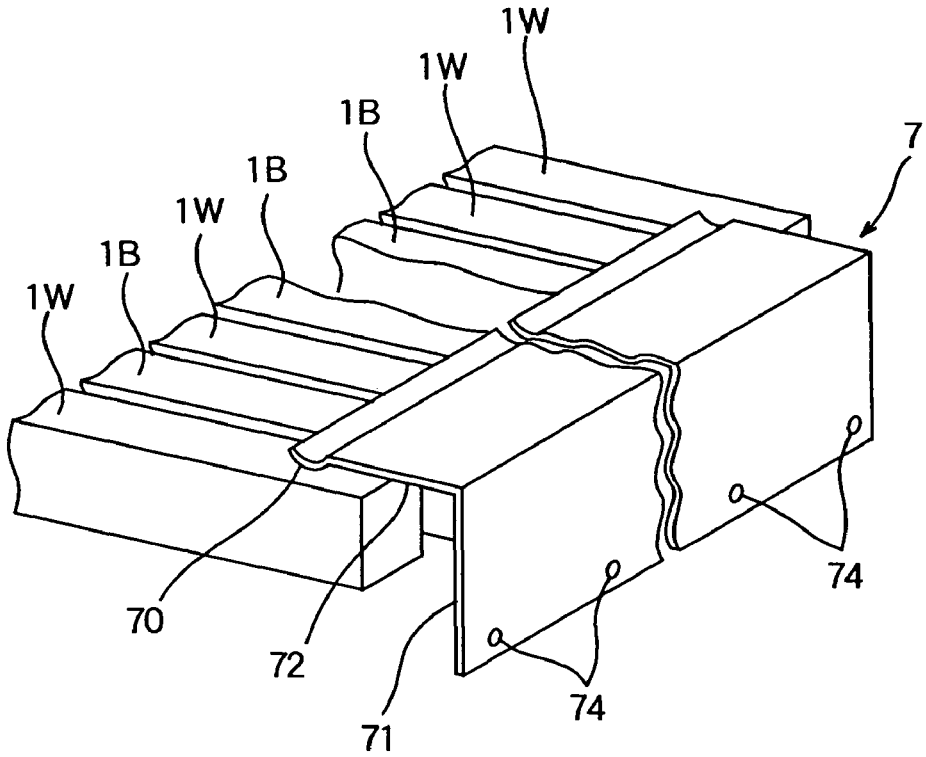
FIG. 2 is a perspective view illustrating keys of the keyboard device depicted in FIG. 1 and a restriction member including an anti-floating part.

In this embodiment, a restriction member 7 is mounted as a stopper on the keyboard frame 3, which is provided with an anti-floating part 70 extending over the plurality of keys on the rear portions of the keys. FIG. 2 shows the rear portions of the keys and the restriction member 7 extracted from the keyboard device. As shown in FIGS. 1 and 2, the restriction member 7 has a function of supporting the anti-floating part 70 on the keyboard frame 3. The keyboard frame 3 is provided with a standing wall 34 which extends in a vertical direction from the rear portion of the keyboard frame 3, and the restriction member 7 is fixed to the keyboard frame 3 by fitting vis screws 35 through coupling holes 74. The restriction member 7 includes a vertical wall 71 which extends upward from the standing wall 34, an upper wall 72 which extends forward from the top portion of the vertical wall, and the anti-floating part 70 which is formed at the front end portion of the upper wall. In this embodiment, the restriction member 7 is formed as a metal plate, and the anti-floating part 70 is formed by curving the metal plate downward. The lower end of the curved shape is positioned near the area just above the pin 31W.

In the present invention, the position near the area just above the supporting part, on which the anti-floating part is positioned, means the area just above the supporting part and its nearby area, and means a range in which front/rear and up/down moving degrees, when viewing the key from above, during the pivoting of the key are small. Specifically, the above position means a range in which resistance to the pivoting of the key when the anti-floating part contacts the top surface of the key is small enough not to give a problem to the musical performance. Preferably, the range is set to be 10 mm to 10 mm from the point just above the supporting part in the front/rear direction, and more preferably, −5 mm to 5 mm.

The anti-floating part 70 is mounted to a position capable of restricting the rising of the rear portion of the white key 1W. In other words, in the non-key pressing state, the anti-floating part 70 is in contact with the white key 1W, or is positioned at a position approximate to the white key 1W with a small gap. When the anti-floating part 70 is in contact with the white key 1W, it can prevent the generation of noise due to the contact with the anti-floating part 70 when the rear portion of the white key 1W is subject to rise. Also, if exerting the down pressing force of the anti-floating part 70 on the white key by using the elasticity of the restriction member 7, the contact status can be more stabilized. The down pressing force is set to have a magnitude of an extent such that it does not hinder the white key's support at the ascended position by the moment by the weight of the mass body 2 in the non-key pressing state.

When the anti-floating part 70 is disposed at a gap from the white key 1W, it can avoid the resistance to the pivoting of the white key 1W, which may occur by the anti-floating part contacting the white key all the time. If the gap is too small, there may happen the problem in that the anti-floating part contacts the white key in the non-key pressing state, caused by errors of dimensions of the components or mounting errors. If the gap is too large, there may happen the problem in that the rising degree of the rear portion of the key until the rise is restricted becomes large and the key support becomes unstable. From this point of view, the gap is preferably set to be smaller than the thickness of the white key, and more preferably, 0.5 mm to 2 mm.

The operation of the keyboard device according to this embodiment will now be described. If applying the key pressing force to the front end portion of the white key 1W, which is positioned forward from the driving portion 4W, the key pressing force interacts with the reaction force applied to the driving portion 4W from the mass body 2, to generate the moment for raising the rear portion of the white, key 1W. Specifically, if the key pressing force is abruptly applied to the key, the rear portion of the key is subject to rise by the moment. However, the rising of the key is restricted by the contact with the anti-floating part 70. Accordingly, the white key 1W can be stably supported. Because the anti-floating part 70 is positioned near the area just above the pin 31W, although contacting the white key 1W, the moving degree at the contact point by the pivoting of the white key 1W is considerably small, and as a result the resistance, like frictional force, to the pivoting is restricted to be small.

As described above, because the black key 1B is configured such that the distance from the front end to the driving portion 4B is short, the problem hardly happens that the rear portion of the black key rises when pressing the key. If the top surface of the black key is positioned at the substantially same height as the top surface of the white key, the rising of the rear portion of the black key can also be prevented by the anti-floating part 70 extending on the black key 1B. Besides, an additional anti-floating part for the black key 1B may be mounted. In this case, it is preferable to arrange the anti-floating part for the black key identically to the arrangement such that the anti-floating part 70 is positioned near the area just above the pin 31W of the supporting part 3W of the white key 1W.

Figure 3:
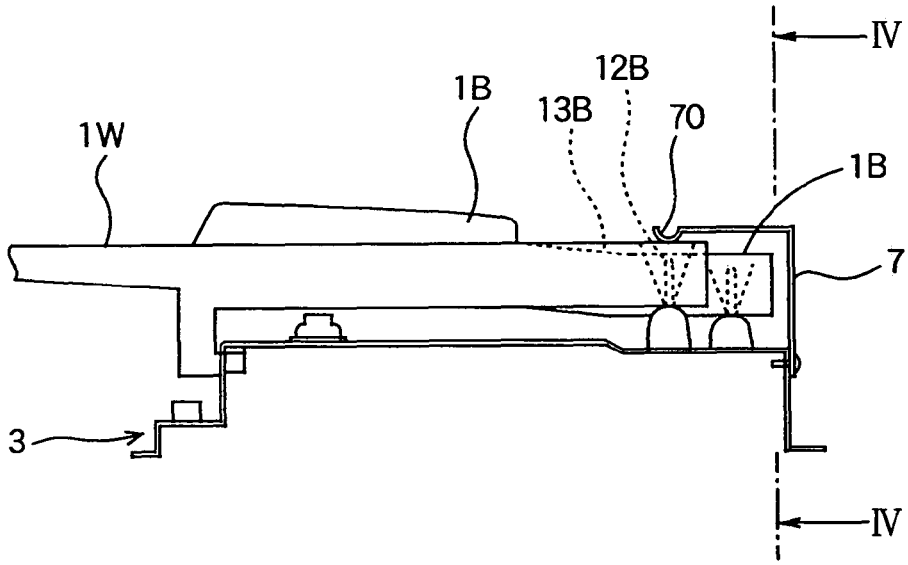
FIG. 3 is a schematic view of essential components of a keyboard device for an electronic musical instrument in accordance with a second embodiment of the present invention.
Figure 4:
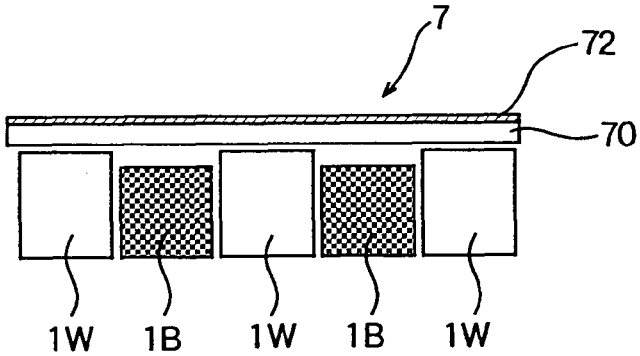
FIG. 4 is a rear view illustrating keys of the keyboard device depicted in FIG. 2 and a restriction member including an anti-floating part.

FIG. 3 shows schematically essential components of a keyboard device for an electronic musical instrument in accordance with a second embodiment of the present invention. In the following description of this embodiment, the different points from the first embodiment will be primarily described, and the explanation of the same or like components will be omitted. In this keyboard device, the black key 1B is shaped such that a portion 12B positioned below the anti-floating part 70 and another portion 13B extending to the portion 12B have a thin thickness. Accordingly, the top surface of the white key 1W is positioned higher than the top surface of the black key 1B. FIG. 4 is a sectional view taken along line IV-IV in FIG. 3, which shows the white key 1W, the black key 1B and the restriction member 7. As shown in the drawing, the gap between the top surface of the black key 1B and the anti-floating part 70 is formed larger than the gap between the top surface of the white key 1W and the anti-floating part 70. In order to secure the difference between the gaps, this embodiment is configured to change the thickness of the black key 1B. Therefore, it is unnecessary to make the difference between the heights of the supporting parts 3W and 3B, and thus the supporting parts can be easily formed. This embodiment has the following effects.

As described above, the black key 1B can be structured such that the distance between the front end and the driving portion is shorter than that of the white key. In such a structure, the moment which is generated when pressing the key and causes the rear portion of the key to rise is small, and the problem of the rising of the rear portion of the key hardly happens. As a result, the anti-floating part can be eliminated under these circumstances. Meanwhile, if the anti-floating part mounted for the white key is also positioned on the black key, there is a possibility that the following problems happen. Because the anti-floating part 70 is positioned near the area just above the supporting part 3W of the white key 1W, even when the white key 1W pivots upwardly on the supporting part 3W by any external force, the shocking contact with the anti-floating part 70 hardly occurs. On the other hand, the anti-floating part 70 is positioned forward from the supporting part 3B of the black key 1B by the distance from the supporting part 3W of the white key 1W to the supporting part 3B. Accordingly, if the black key 1B pivots upwardly on the supporting part 3B by any external force, the distance between the supporting part 3B to the anti-floating part 70 becomes a rotation radius, and there is a possibility that the black key 1B comes into shocking contact with the anti-floating part 70. Such contact may cause noise, and may hinder the musical performance. To cope with the above problem, this embodiment is structured such that the top surface of the black key 1B is positioned lower than the top surface of the white key 1W in the area below the anti-floating part 70. Thus, although the black key pivots upwardly as described above, the collision of the black key with the anti-floating part 70 can be avoided by the large gap to the anti-floating part 70. Accordingly, the occurrence of noise can be prevented. Preferably, the difference in the heights between the top surface of the black key 1B and the top surface of the white key 1W is set to be 0.5 mm to 5 mm. The upper limit value of difference in the heights is sufficient to provide the avoidance of the collision due to the typical upward-pivoting. If the difference is below the lower limit value, the avoidance of the collision cannot be achieved sufficiently.

Figure 5:
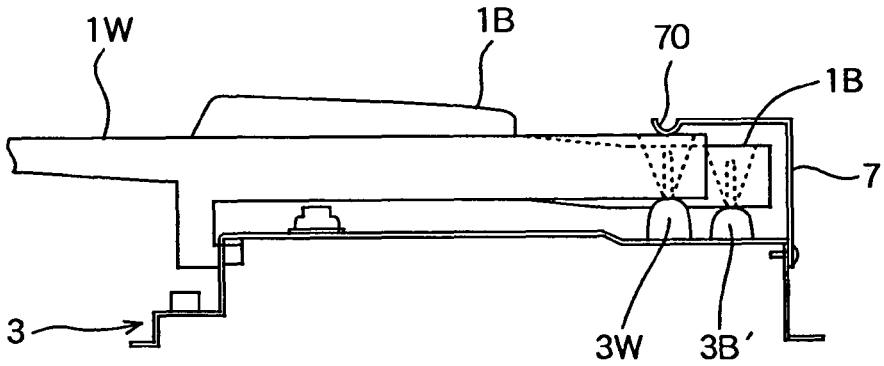
FIG. 5 is a schematic view of essential components of a keyboard device for an electronic musical instrument in accordance with a third embodiment of the present invention.

FIG. 5 shows schematically essential components of a keyboard device for an electronic musical instrument in accordance with a third embodiment of the present invention. In this embodiment, the black key 1B positioned below the anti-floating part 70 is supported by a supporting part 3B' whose supporting position is lowered. Thus, the top surface of the white key 1W is positioned higher than the top surface of the black key 1B. As a result, the gap between the top surface of the black key 1B and the anti-floating part 70 is formed larger than the gap between the top surface of the white key 1W and the anti-floating part 70. Also in this case, based on the difference between the gaps, this embodiment has the same effect as the second embodiment. Particularly, because it is unnecessary to partially change the thickness of the black key 1B, this embodiment has an advantage of manufacturing the black key in common with the white key in aspects of designing a shape or a strength of the key, using manufacturing equipment like a mold, or adopting the related components.

Besides, it is also possible to combine the setting of the thickness of the black key 1B in the second embodiment with the setting of the supporting position of the supporting part in the third embodiment.

Figure 6:
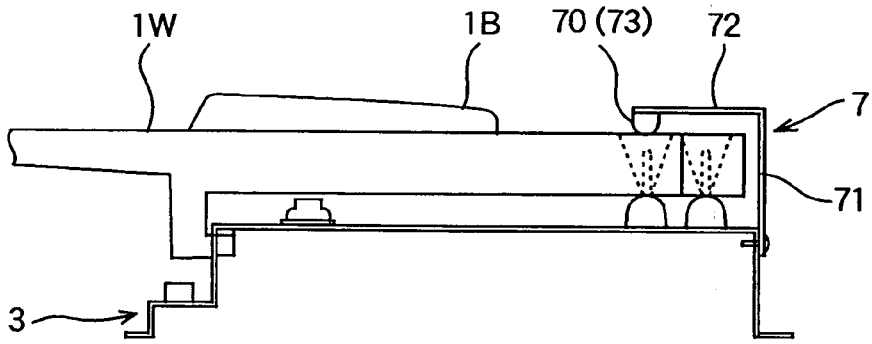
FIG. 6 is a schematic view of essential components of a keyboard device for an electronic musical instrument in accordance with a fourth embodiment of the present invention.

FIG. 6 shows schematically essential components of a keyboard device for an electronic musical instrument in accordance with a fourth embodiment of the present invention. In this embodiment, the anti-floating part 70 is provided with an elastic body 73, and is in contact with the top surface of the white key 1W in the non-key pressing state. The elastic body 73 may be configured as a sponge foam, a fiber member such as felt, silicone rubber, gel, or the like. The elastic body 73 is attached to the lower surface of the front end portion of the upper wall 72 of the restriction member 7. The elastic body 73 may be coupled to another member to be disposed to any one of the upper end portion, the middle portion, or the lower end portion of the anti-floating part.

In this embodiment, because the anti-floating part 70 is provided with the elastic body 73, it is easy to exert an adequate contact pressure on the white key 1W, and the position of the white key on the supporting part can be kept stably. Also, since the elastic body compensates the errors of dimensions in the up/down direction, the requirement of the precision of dimensions of the components and the mounting is mitigated, and thus the manufacturing process and the mounting process can be performed easily.

Figure 7:
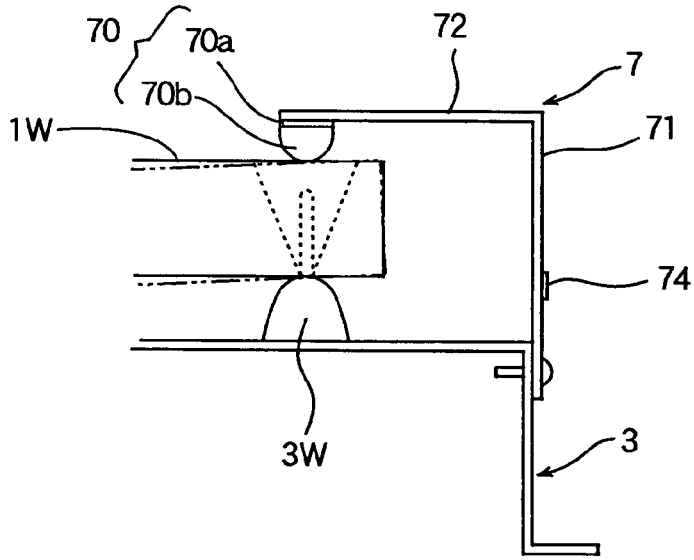
FIG. 7 is a schematic view of essential components of a keyboard device for an electronic musical instrument in accordance with a fifth embodiment of the present invention.

FIG. 7 shows schematically essential components of a keyboard device for an electronic musical instrument in accordance with a fifth embodiment of the present invention. In this embodiment, the anti-floating part 70 is provided with a pressure sensor 70*a*. It is illustrated in the drawing that the pressure sensor 70*a* is mounted between an elastic body 70*b* and the upper wall 72. The anti-floating part 70 is in contact with the top surface of the white key 1W in the non-key pressing state. According to the small change of the contact pressure by the pivoting of the white key 1W (shown by a dashed dotted line in the drawing) when pressing the key, the pressure sensor 70*a* generates a detecting signal. The pressure sensor 70*a* may be configured as a variable resistance type pressure sensor, and can detect whether the white key 1W pivots or not and the pivoting degree. Also, besides combining the pressure sensor 70*a* with the elastic body 70*b*, the pressure sensor 70*a* itself may be formed in a unitary unit as a pressure sensitive sensor by a conductive rubber.

FIG. 7 illustrates another pressure sensor 74 which is mounted to the vertical wall 71 of the restriction member 7. When the anti-floating part 70 is pressed upwardly by the white key 1W, the restriction member 7 is elastically deformed from the upper wall 72 to the vertical wall 71, and the deformation degree is detected by the pressure sensor 74. The pressure sensor 74 may be configured as a strain gauge. Because the pressure sensor 74 detects the elastic deformation degree due to the bending of the restriction member 7, the pressure sensor 74 can achieve the highly precise detection, and can successively or intermittently generate an accurate detecting signal according to the pivoting degree of the white key 1W. The pressure sensor 74 may be mounted to substitute for the aforesaid pressure sensor 70*a*, or may be mounted additionally to the pressure sensor 70*a*. When the pressure sensor 74 is mounted additionally to the pressure sensor 70*a*, the pressure sensor 70*a* can be allotted to detect whether the white key pivots or not, and the pressure sensor 74 can be allotted to detect the pivoting degree. The pressure sensor 74 may be mounted to the upper wall 72.

The pressure sensor 70*a* may be configured to extend successively together with the upper wall 72 over the plurality of keys. In this case, the pressure sensor 70*a* generates a detecting signal by the pivoting of any key contacting thereto. Also, the pressure sensor 70*a* may be mounted independently to each key. In this case, each pressure sensor 70*a* generates a detecting signal by the pivoting of the key corresponding thereto. The pressure sensor 70*a* may be mounted independently to each black key 1B as well as each white key 1W. Also, the upper wall 72, or both the upper wall 72 and the vertical wall 71, may be formed with a slit, to thereby make the anti-floating part 70 perform independently the response operation to the pivoting of each key. The pressure sensor 74 may also be configured to extend successively over the plurality of keys, or to be mounted independently to each key, identically to the above description. Even when one pressure sensor 74 is mounted to the restriction member 7 which extends successively over the plurality of keys, if the restriction member 7 is elastically deformed by the pivoting of any key, the pressure sensor 74 can generate a detecting signal, thereby simplifying the structure.

As described above, by the pressure sensors 70*a* and 74 detecting whether the key pivots or not and the pivoting degree, the detecting signal can be used for the on/off control of the sound production and the after-touch control.

Figure 8:
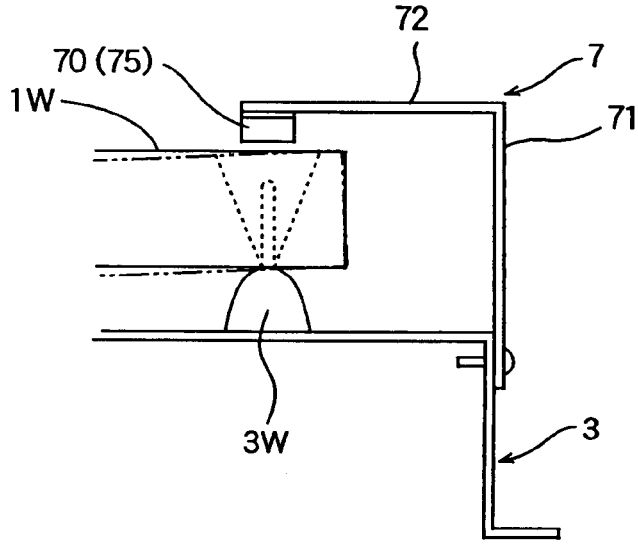
FIG. 8 is a schematic view of essential components of a keyboard device for an electronic musical instrument in accordance with a sixth embodiment of the present invention.

FIG. 8 shows schematically essential components of a keyboard device for an electronic musical instrument in accordance with a sixth embodiment of the present invention. In this embodiment, the anti-floating part 70 is provided with a non-contact type proximity sensor 75. The proximity sensor 75 generates a detecting signal according to even a small change of a gap with the top surface of the white key by the pivoting of the white key 1W (shown by a dashed dotted line in the drawing) when pressing the key. Accordingly, the proximity sensor 75 is not needed to contact the top surface of the white key, and thus the white key can pivot without receiving resistance like frictional force due to the contact. The proximity sensor 75 may be configured as an electronic inductive sensor, an electrostatic capacity sensor, a photoreflector, or the like, which can detect whether the white key 1W pivots or not and the pivoting degree. Whether to successively extend the anti-floating part 70 over the plurality of keys or independently mount the anti-floating part 70 to each key can be determined from the identical aspect to the pressure sensor 70*a* as described above.

The present invention is not restricted to the above embodiments, and can be variously modified. In substitute for the structure in which the pins are supported by the keyboard frame as illustrated in the drawings, the supporting parts of the white keys and the black keys may be modified such that the pins are supported by the keys and the keyboard frame is provided with receiving portions for receiving the pins. The supporting parts can also be modified into other supporting structures that can pivotably support the keys.

Figure 9:
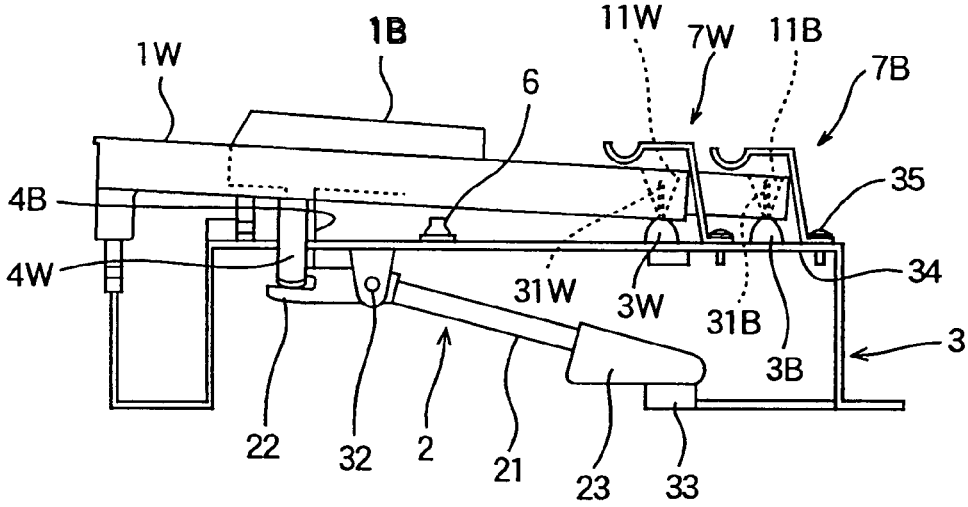
FIG. 9 is a schematic view of essential components of a keyboard device for an electronic musical instrument in accordance with a seventh embodiment of the present invention.

FIG. 9 shows schematically essential components of a keyboard device for an electronic musical instrument in accordance with a seventh embodiment of the present invention. The keyboard device is structured such that a plurality of white keys 1W, a plurality of black keys 1B, and a plurality of mass bodies 2 interlocking with the respective keys are supported by a keyboard frame 3.

The rear end portions of the white keys 1W and the black keys 1B are respectively supported by supporting parts 3W and 3B, so that the white keys 1W and the black keys 1B can pivot in a vertical direction. The white keys 1W and black keys 1B are respectively provided with driving portions 4W and 4B for the mass bodies at slightly retreated positions from the front ends of the keys. The supporting parts 3W and 3B are provided with pins 31W and 31B which extend upward from the keyboard frame 3. The white keys 1W and the black keys 1B are formed with funnel-shaped holes 11W and 11B, into which the pins are inserted. By the holes 11W and 11B receiving the pins 31W and 31B, the keys are supported by the supporting parts.

As shown in the drawing, the supporting part 3B of each black key 1B is positioned rearward from the supporting part 3W of each white key 1W. Because the front end of the black key is located at a retreated position from the front end of the white key, the positions of the supporting parts 3B and 3W are determined from aspects of decreasing a difference in rotation radii from key pressing points to the supporting parts between the white key and the black key and decreasing a difference in touch feelings between the white key and the black key. To this end, it is preferred that the distance between two supporting parts is set to be 20 to 200% of the distance from the front end of the white key to the front end of the black key. If the distance is less than 20%, the difference in rotation radii between the black key and the white key becomes large, and the difference in touch feelings between the white key and the black key cannot be decreased. Also, if the distance is more than 200%, the black key is extended rearward so excessively that the dimension of the keyboard device in the front/rear direction becomes large.

Because the white key and the black key have the same constitution of the mass body 2, a switch 6 and a touch control sensor, the constitution of the white key will now be described, but the explanation of the constitution of the black key will be omitted. The mass body 2 is rotatably supported by the keyboard frame 3 by a shaft 32 which is coupled to a portion near a front end of a rod 21. The mass body 2 is connected to the driving portion 4W of the white key 1W at a front end portion 22, and is provided with a weight 23 at a rear end portion. In a non-key pressing state, the weight 23 of the mass body 2 is positioned on a stopper 33 of the keyboard frame 3 by its own weight, and the front end portion 22 of the mass body 2 raises the white key 1W to an ascended position. The driving portion 4W of the white key is formed with a hook 41W. The uppermost ascended position of the white key is determined when the hook contacts the keyboard frame 3. The switch 6 is mounted on the keyboard frame 3, just below the white key 1W. When the white key 1W is pressed down, in response to the pressing, the switch 6 transmits a sound generating signal to a control unit (not shown) to generate sound. The switch 6 can be configured as various commonly-used types such as a contact type, a non-contact type, etc. Also, in order for the keyboard device to have a touch control function, the keyboard device may further include a sensor to detect a velocity of the key and a contact pressure when pressing the key. The switch and the sensor may be mounted on the operating position of the mass body.

Figure 10:
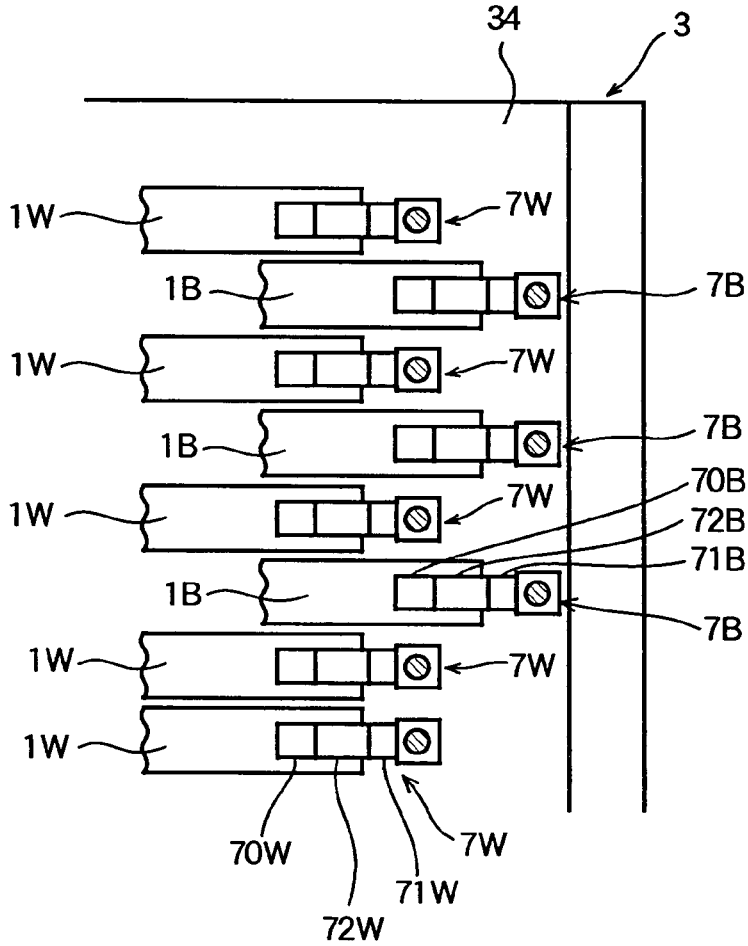
FIG. 10 is a plan view illustrating rear portions of keys of the keyboard device depicted in FIG. 9 and a restriction member including an anti-floating part.
Figure 11:
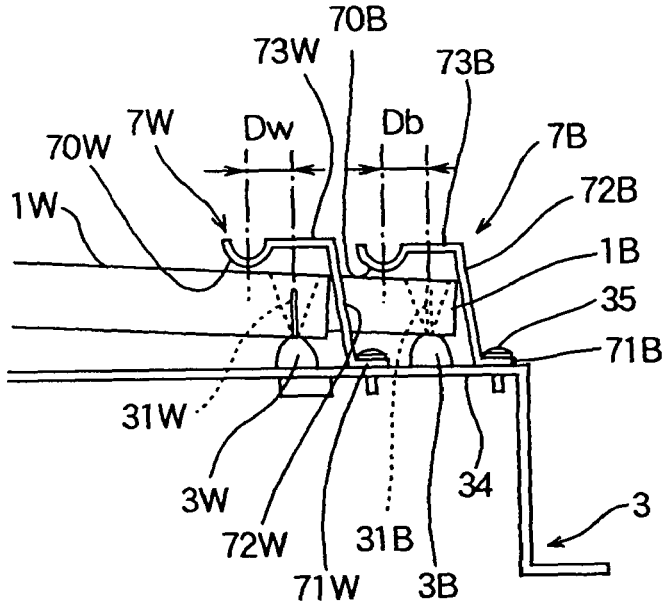
FIG. 11 is an enlarged view of a region near the rear portions of the keys depicted in FIG. 9.

In this embodiment, a white key restriction member 7W is mounted near the rear portion of the white key 1W, and a black key restriction member 7B is mounted near the rear portion of the black key 1B. FIG. 10 is a plan view showing the rear portions of the keys and the restriction members 7W and 7B, and FIG. 11 is an enlarged view of a region near the rear portions of the keys depicted in FIG. 9. The restriction members 7W and 7B are mounted to the rear portion of the keyboard frame 3 in such a manner that lower end portions 71W and 71B of the restriction members 7W and 7B are fixed to a horizontal wall 34 of the keyboard frame 3 by using vis screws 35. The respective restriction members 7W and 7B include vertical walls 72W and 72B which extend upward from the lower end portions 71W and 71B, upper walls 73W and 73B which extend forward from the upper end portions of the vertical walls, and anti-floating parts 70W and 70B which are mounted to the front end portions of the upper walls. In this embodiment, the restriction members 7W and 7B are formed as metal plates, and the anti-floating parts 70W and 70B are formed by curving the metal plates downward.

The anti-floating parts 70W and 70B are mounted to positions capable of restricting the rising of the rear portions of the white key 1W and the black key 1B. In other words, in the non-key pressing state, the anti-floating parts are in contact with the white key and the black key, or are positioned at positions approximate to the keys with a small gap. When the anti-floating parts are in contact with the keys, it can be securely prevented the generation of noise due to the contact with the anti-floating parts when the rear portions of the keys are subject to rise. Also, if exerting the downward pressing force of the anti-floating parts on the keys by using the elasticity of the restriction members 7W and 7B, the contact status can be more stabilized. The downward pressing force is set to have a magnitude of an extent such that it does not hinder each key's support at the ascended position by the moment by the weight of the mass body 2 in the non-key pressing state.

When each anti-floating part is disposed approximately to each key at a small gap, it can avoid the resistance to the pivoting of the key, which may occur by the anti-floating part contacting the key all the time. If the gap is too small, there may happen the problem in that the anti-floating part contacts the key in the non-key pressing state, caused by errors of dimensions of the components or mounting errors. If the gap is too large, there may happen the problem in that the rising degree of the rear portion of the key until the rise is restricted becomes large and the key support becomes unstable. From this point of view, the gap is preferably set to be smaller than the thickness of the white key, and more preferably, 0.5 mm to 2 mm.

The arrangement of contacting the anti-floating part to the top surface of the key or disposing the anti-floating part approximately to the top surface of the key is applied to the embodiments which will be described hereinafter.

The anti-floating parts 70W and 70B are positioned such that contact center points with the top surfaces of the keys (lower ends of the curved shape in the drawings) are positioned respectively at distances Dw and Db from points just above the supporting parts 3W and 3B (pins 31W and 31B). The distances Dw and Db are determined so that the restriction members 7W and 7B are positioned rearward from the visible portions of the keys (portions seen from the front of the instrument). If the distances Dw and Db are too large, the distance from the supporting part to the anti-floating part becomes a rotation radius, and there is a possibility that the key comes into shocking contact with the anti-floating part. Accordingly, when the front direction from the supporting parts 3W and 3B is defined as "+" and the rear direction from the supporting parts 3W and 3B is defined as "−", the distances Dw and Db are preferably set to be 30 mm to +30 mm, and more preferably, −5 mm to +5 mm. Also, if the rear ends of the keys are shorter than the aforesaid lower limit dimension, the lower limits of the distances Dw and Db fall on the rear ends of the keys.

The distances Dw and Db are almost equal to each other, such that a difference between the distances is preferably within 10 mm.

Figure 12:
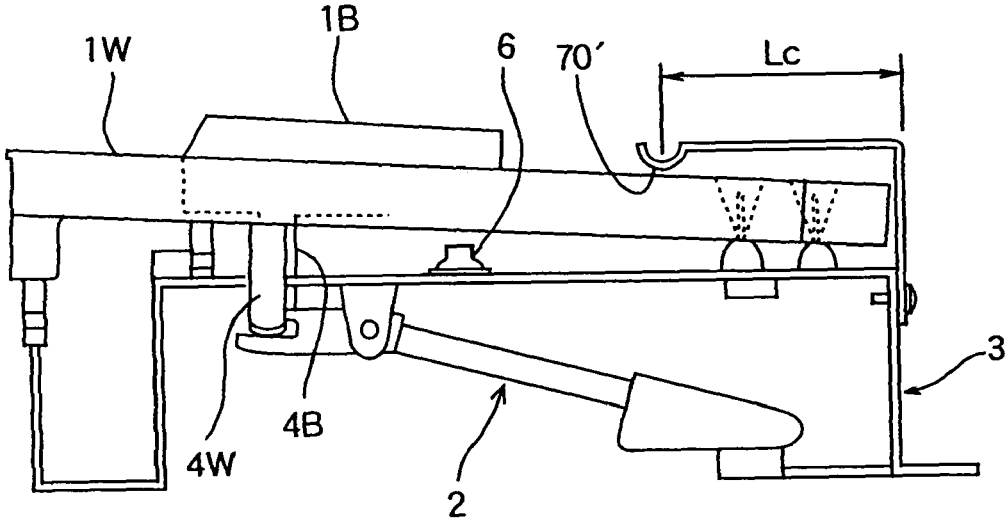
FIG. 12 is a schematic view of essential components of a keyboard device for an electronic musical instrument in accordance with an eighth embodiment of the present invention.
Figure 13A:
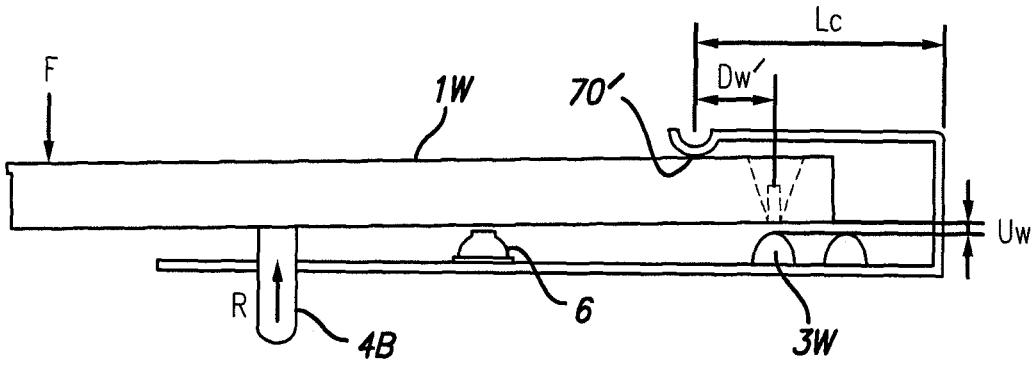
FIGS. 13(*a*) and 13(*b*) are an explanation view of operation of the keyboard device depicted in FIG. 12 when pressing the keys.
Figure 13B:
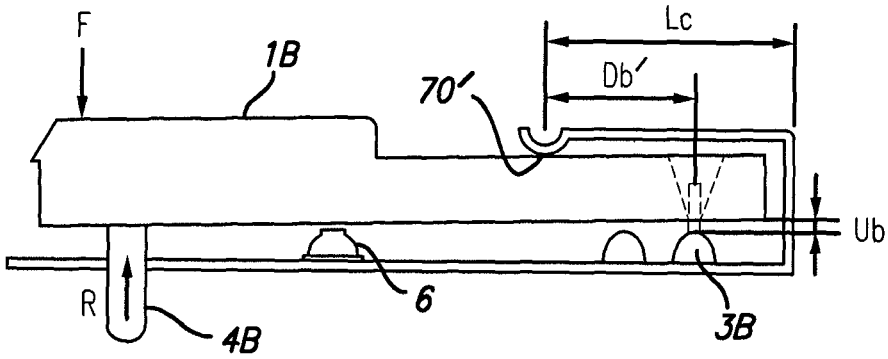

Like this, by providing a common feature to the distances Dw and Db, the operation of the white keys and the black keys can be made uniform, which will be described in detail later. Contrarily to the above structure, FIG. 12 shows an example structured such that an anti-floating part 70' is mounted to the keyboard frame 3 at the same distance Lc from the rear end of the keyboard frame 3 with respect to the white key 1W and the black key 1B. The operation of the white key 1W and the operation of the black key 1B in this structure when pressing the keys are respectively illustrated in FIG. 13(*a*) and FIG. 13(*b*). If the large key pressing force F is applied, the reaction force of inertia R by the key and the mass body becomes also large, and a couple of forces are generated at the key to pivot the same to the left on the drawing. This causes the rising of the rear end of the key. The rising is restricted by the rear end of the key contacting the anti-floating part 70'. In this case, because a distance Db' from the black key supporting part 3B to the anti-floating part 70' is larger than a distance Dw' from the white key supporting part 3W to the anti-floating part 70', a rising degree Ub of the black key from the supporting part becomes obviously larger than a rising degree Uw of the white key from the supporting part. The difference in operation between the black key and the white key has an influence on the operation of the switch 6 and the noise generation due to the collision with the supporting parts, and as a result causes ununiformity of basic features of the keyboard.

As described above, in the seventh embodiment illustrated in FIGS. 9 to 11 although the large key pressing force is applied and the rear portions of the keys rise, the anti-floating parts 70W and 70B can restrict the rising of the keys at the positions at the same distance from the supporting parts 3W and 3B. As a result, the rising degrees from the supporting parts 3W and 3B are almost same, and the operational performance of the switch 6 is made uniform. In order to prevent the noise due to the rising, a measure of providing a soft member may be adopted. However, because to stop the operation of the key softly may have a bad influence by making it ambiguous to perceive a boundary condition forming the sound generating state and the touch feeling, the setting of the softness must be performed very cautiously. In relation to this, by adopting the aforesaid anti-floating parts, the rising degrees of the white key 1W and the black key 1B from the supporting parts 3W and 3B are almost equal to each other, and thus the noise prevention can be achieved accurately and effectively.

If the distances Dw and Db are set to zero or a value approximate to zero, the anti-floating parts are respectively positioned at an area or near an area just above the white key supporting part and the black key supporting part. In this state, although the keys pivot while being restricted by the anti-floating parts, the positions of the supporting parts which are original pivoting centers and the keys in the longitudinal direction are hardly changed. As a result, the operation of the keys are performed stably regardless of whether the rear portions of the keys rise or not, and operational performance of the switch 6 related to the up/down movement of the keys is stabilized. The above-described setting of the distances Dw and Db can also be applied to the respective following embodiments.

Figure 14:
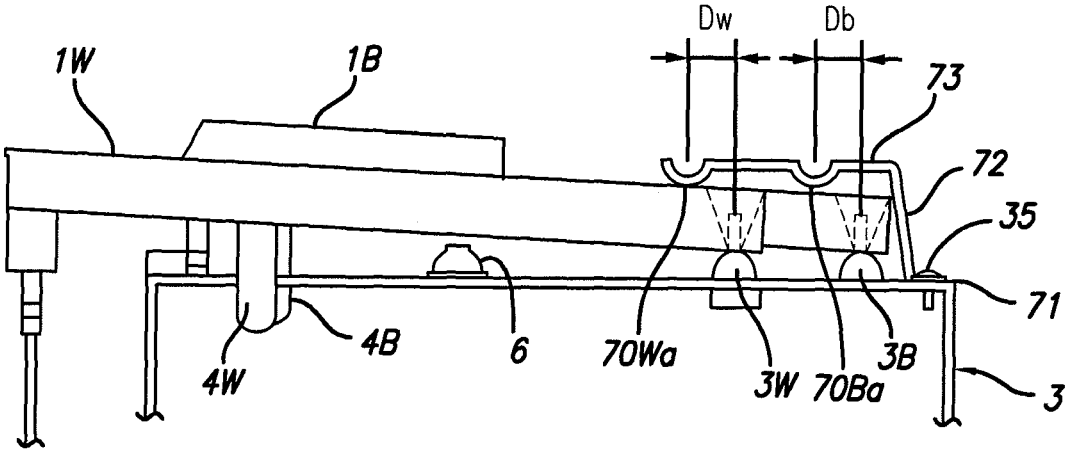
FIG. 14 is a schematic view of essential components of a keyboard device for an electronic musical instrument in accordance with a ninth embodiment of the present invention.
Figure 15:
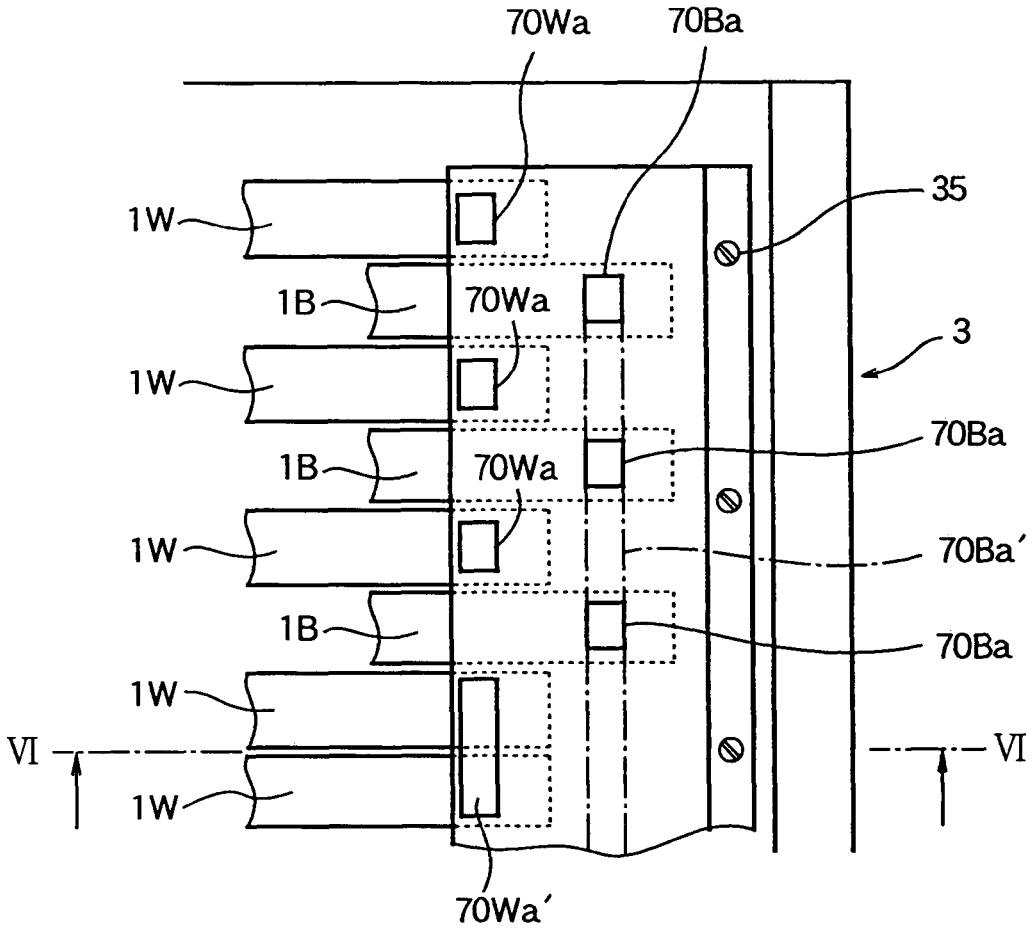
FIG. 15 is a plan view illustrating rear portions of keys of the keyboard device depicted in FIG. 14 and a restriction member including an anti-floating part.

FIGS. 14 and 15 show schematically essential components of a keyboard device for an electronic musical instrument in accordance with an eighth embodiment of the present invention. Particularly, FIG. 14 is a longitudinal-sectional view of the essential components of the keyboard device, and FIG. 15 is a plan view of the essential components of the keyboard device, in which a section taken along line VI-VI is shown in FIG. 14. In the following description of this embodiment, the different features from the seventh embodiment will be primarily explained, and the explanation of the same or like parts will be omitted.

In the keyboard device of this embodiment, the anti-floating parts are mounted to the restriction member 7 which extends over the plurality of keys including the white keys and the black keys. In other words, the restriction member 7 extends lengthwise in the key arranging direction, and is mounted to the rear portion of the keyboard frame 3 in such a manner that a lower end portion 71 of the restriction member 7 is fixed to a horizontal wall 34 of the keyboard frame 3 by using vis screws 35. The restriction member 7 includes a vertical wall 72 which extends upward from the lower end portion 71, and an upper wall 73 which extends forward from the upper end portion of the vertical wall. The restriction member 7 is formed as a metal plate. The anti-floating parts 70Wa and 70Ba are formed by deforming the metal plate in a downward concave shape, and the lower ends of the curved shape are positioned respectively at distances Dw and Db from points just above the supporting parts 3W and 3B (pins 31W and 31B). The setting of the distances Dw and Db and its operational effect which have been explained with reference to the seventh embodiment can also be applied to this embodiment and other embodiments which will be described later.

The keyboard has sections in which two white keys are consecutively arranged. An anti-floating part 70Wa' positioned in this section can be formed in a concave shape which covers two keys. Also, because the anti-floating part of the black key 1B is positioned rearward from the anti-floating part of the white key 1W, although it is provided with an anti-floating part 70Ba' which extends in the key arranging direction in a concave shape to cover the plurality of keys, as shown by a dashed dotted line in the drawing, the anti-floating part 70Ba' does not interfere with the anti-floating part 70Wa of the white key 1W.

According to this structure, because a plurality of anti-floating parts are formed at one restriction member 7, the mounting process to the keyboard frame and the position adjusting process with respect to the keys can be performed rapidly and easily.

Figure 16:
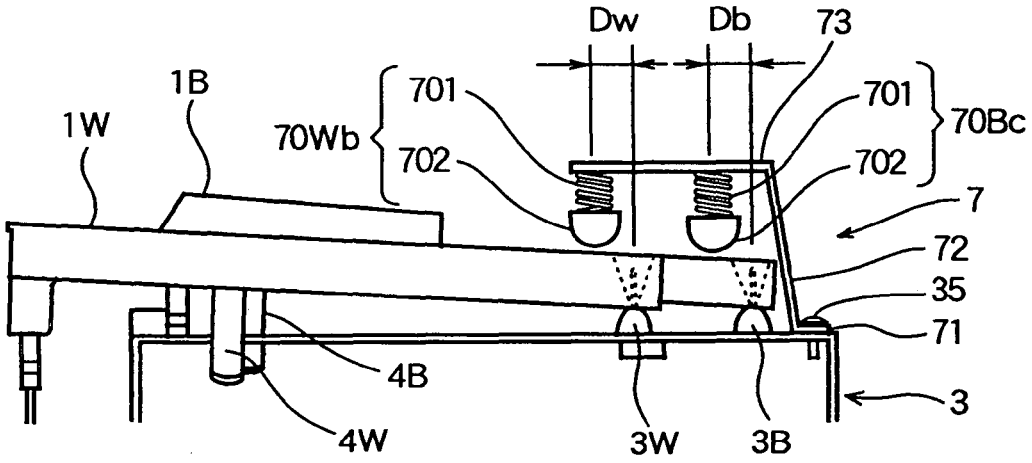
FIG. 16 is a schematic view of essential components of a keyboard device for an electronic musical instrument in accordance with a tenth embodiment of the present invention.

FIG. 16 shows schematically essential components of a keyboard device for an electronic musical instrument in accordance with a ninth embodiment of the present invention. In this embodiment, the restriction member 7 extends over the plurality of white keys and black keys, identically to the eighth embodiment shown in FIGS. 14 and 15, and an anti-floating part 70Wb of the white key and an anti-floating part 70Bb of the black key are mounted to the upper wall 73 of the restriction member 7. In other words, this embodiment is structured such that the anti-floating parts 70Wa, 70Wa' and 70Ba of the eighth embodiment are substituted by the anti-floating parts 70Wb and 70Bb. Each of the anti-floating parts 70Wb and 70Bb includes an elastic body 701 whose upper end is fixed to the upper wall 73, and a contact piece 702 which is fixed to the lower end of the elastic body 701. The elastic body 701 may be configured as a spring, such as a coil spring or a plate spring, a sponge foam, or the like. By such an elastic body provided at the anti-floating part, when the rear end portion of the key rises, a downward pressing force to press down the rear end portion of the key correspondingly to the rising degree can be obtained. Accordingly, the restricting operation is stably achieved.

In order to acquire the above operational effect, it is structured such that the anti-floating part and the key contact each other with elasticity. The elastic body may be mounted to any one of the upper end portion, the middle portion, or the lower end portion of the anti-floating part. When the elastic body is mounted to the lower end portion of the anti-floating part, the contact piece 702 can be eliminated. Alternatively, the elastic body may be mounted on the top surface of the key, in substitute for or in addition to the anti-floating part.

Figure 17:
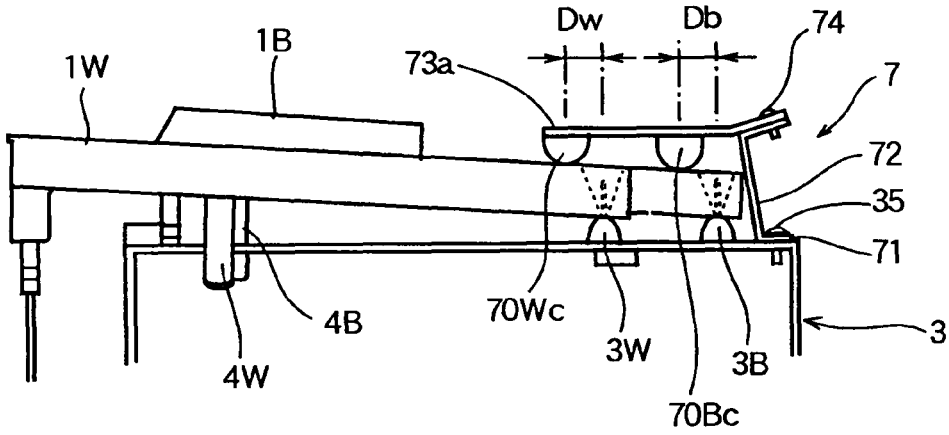
FIG. 17 is a schematic view of essential components of a keyboard device for an electronic musical instrument in accordance with an eleventh embodiment of the present invention.

FIG. 17 shows schematically essential components of a keyboard device for an electronic musical instrument in accordance with a tenth embodiment of the present invention. In this embodiment, an upper wall 73*a* of the restriction member 7 is formed as an elastic piece. The restriction member 7 extends over the plurality of white keys and black keys, identically to the eighth embodiment shown in FIGS. 14 and 15, and the upper wall 73*a* is mounted to the vertical wall 72 extending upward from the lower end portion 71 by using vis screws 74, so as to have spring characteristics. The upper wall 73*a* is provided with anti-floating parts 70Wc and 70Bc at the positions corresponding to the white key and the black key. By this structure, the upper wall 73*a* biases the anti-floating parts 70Wc and 70Bc respectively to the white key and the black key. According to the intensity of the elasticity of the upper wall 73, the anti-floating parts 70Wc and 70Bc has elasticity or softness, or does not. When having the elasticity or the softness, the elastic body or soft body may be configured as a sponge foam, a fiber member such as felt, silicone rubber, gel, or the like, and are attached to the lower surface of the front end portion of the upper wall 72 of the restriction member 7. The elastic body may be coupled to another member to be disposed to any one of the upper end portion, the middle portion, or the lower end portion of the anti-floating part.

Also in this embodiment, by the structure that the anti-floating part and the key contact each other with elasticity, when the rear end portion of the key rises, a downward pressing force to press down the rear end portion of the key correspondingly to the rising degree can be obtained, and thus the restricting operation is stably achieved.

Figure 18:
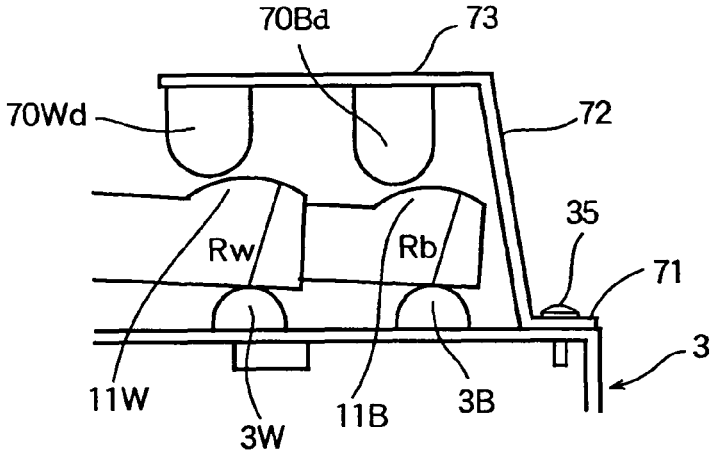
FIG. 18 is a schematic view illustrating a keyboard device for an electronic musical instrument in accordance with a twelfth embodiment of the present invention.

FIG. 18 shows schematically essential components of a keyboard device for an electronic musical instrument in accordance with an eleventh embodiment of the present invention. In this embodiment, rear end portions 11W and 11B of the keys opposing anti-floating parts 70Wd and 70Bd are formed in circular arc shapes which have radii Rw and Rb centering on the centers of the pivoting by the supporting parts 3W and 3B, when viewing the side surfaces of the keys (viewing in the key arranging direction). The restriction member 7 extends over the plurality of white keys and black keys, identically to the eighth embodiment shown in FIGS. 14 and 15, and the anti-floating parts 70Wd and 70Bd are mounted to the positions corresponding to the white key and the black key, at small gaps from the rear end portions 11W and 11B of the keys.

Because the rear end portions 11W and 11B of the keys are formed in the circular arc shapes, regardless of the pivoting degree of the key (descending degree of the front end portion of the key), the gaps between the rear end portions 11W and 11B of the keys and the anti-floating parts 70Wd and 70Bd are maintained constantly. Accordingly, the status that the rear end portions 11W and 11B of the keys are restricted by the anti-floating parts 70Wd and 70Bd by contacting them when the rear portions of the keys rise, is made uniform, regardless of the pivoting degree of the key. As a result, the rising degrees from the supporting parts 3W and 3B are almost the same, and the operational performance of the switch 6 related to the vertical position of the key is made uniform. Also when adopting a measure of providing a soft member to prevent the noise due to the rising, the setting about the soft member can be achieved accurately and effectively.

Figure 19:
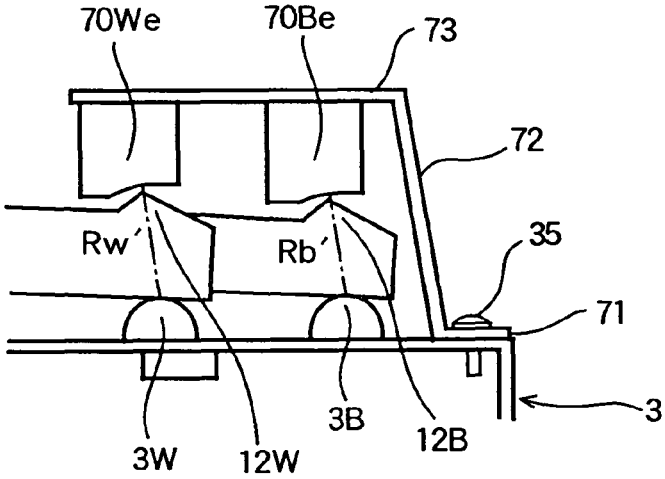
FIG. 19 is a schematic view illustrating a keyboard device for an electronic musical instrument in accordance with a thirteenth embodiment of the present invention.

FIG. 19 shows schematically essential components of a keyboard device for an electronic musical instrument in accordance with a twelfth embodiment of the present invention. This embodiment is structured such that the forming into the circular arc shape in the eleventh embodiment is applied to the anti-floating parts. The lower surfaces of the anti-floating parts 70We and 70Be are formed in circular arc shapes which have radii Rw' and Rb' centering on the centers of the pivoting by the supporting parts 3W and 3B, when viewing the side surfaces of the keys. Rear end portions 12W and 12B of the keys opposing the anti-floating parts 70We and 70Be are formed in convex shapes, each having an angle portion on the top surface to point-contact the lower surface of each anti-floating part, when viewing the side surfaces of the keys.

Similarly to the eleventh embodiment, because the lower surfaces of the anti-floating parts 70We and 70Be are formed in the circular arc shapes, regardless of the pivoting degree of the key, the gaps between the rear end portions 12W and 12B of the keys and the anti-floating parts 70We and 70Be are maintained constantly, and the status that the rear end portions 12W and 12B of the keys are restricted by the anti-floating parts 70We and 70Be by contacting them, is made uniform. As a result, the operational performance of the switch 6 related to the vertical position of the key is made uniform, and the setting for preventing the noise due to the rising can be achieved accurately and effectively.

In order to obtain the effects by the circular arc-shaped parts, as described in the fifth and twelfth embodiments, at least one of the anti-floating part and the key in the contact area therebetween is formed in a circular arc shape centering on the supporting part. Accordingly, both the anti-floating part and the key may be formed in the complementary circular arc shapes, i.e., the convex and concave shapes of the fifth and twelfth embodiments, to contact each other when the rear portion of the key rises.

Figure 20:
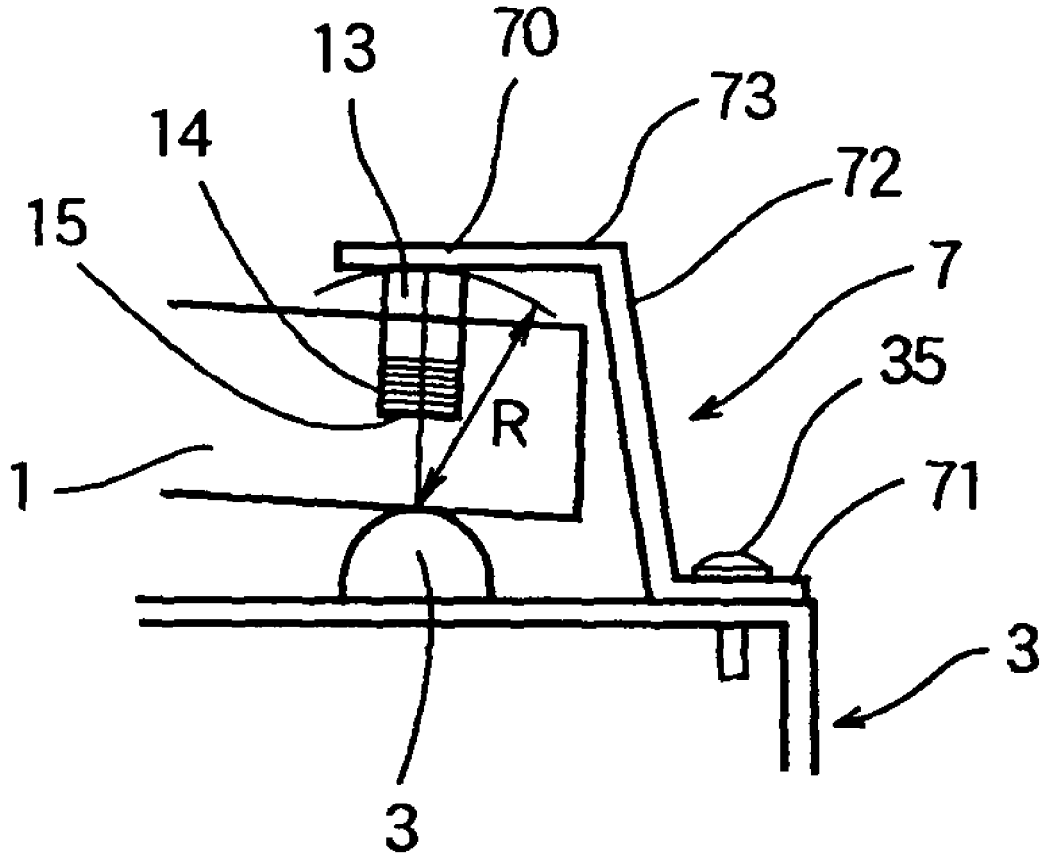
FIG. 20 is a schematic view illustrating a modification of the embodiments depicted in FIGS. 18 and 19.

As shown in FIG. 20, the circular arc-shaped contact structure can be modified into a structure that a contact member 13 is slidably inserted into a receiving hole 15 formed at the rear end portion of the key 1, and an elastic body 14 is provided between the bottom of the receiving hole and the contact member 13 to bias the contact member 13 in the protruding direction. The elastic body 14 may be configured as a spring, a sponge foam, or the like. A contact portion of the contact member 13 to the anti-floating part 70 is formed in a circular arc shape having a radius R centering on the center of the pivot by the supporting part 3. In the non-key pressing state, the contact member 13 is in contact with the anti-floating part 70. The contact status and the restriction receiving status in pressing the key are made uniform regardless of the pivoting degree of the key. As a result, the operational performance of the switch 6 related to the vertical position of the key is made uniform, and the setting for preventing the noise due to the rising can be achieved accurately and effectively.

This embodiment is structured such that the anti-floating part 70 is formed by the upper wall 73 of the restriction member 7, however it can be modified to have other types of anti-floating parts illustrated in the previous embodiments. The structure of the slidably-mounted contact part and the elastic body can be mounted to the anti-floating part.

The present invention is not limited to the above embodiments, and can be variously modified. In substitute for the structure in which the pins are supported by the keyboard frame as illustrated in the drawings, the supporting parts of the white keys and the black keys may be modified such that the pins are supported by the keys and the keyboard frame is provided with receiving portions for receiving the pins. The supporting parts can also be modified into other supporting structures that can pivotably support the keys. The anti-floating parts of the respective embodiments can be mounted to the restriction members arranged for each white key and each black key as shown in FIGS. 9 to 11, or can be mounted to the restriction members extending over the plurality of keys as shown in FIGS. 14 and 15.

The invention claimed is:

1. A keyboard device for use in an electronic musical instrument, comprising a keyboard frame, a plurality of keys including white keys and black keys arranged on the keyboard frame, each key having a front portion close to a performer and a rear portion opposite to the front portion, and supporting parts mounted on the keyboard frame for supporting the keys pivotably downward and upward, wherein the supporting parts include white key supporting parts to support the white keys and black key supporting parts to support the black keys, the supporting parts being positioned at the rear portions of the keys such that the black key supporting parts are arranged rearward relative to the white key supporting parts, wherein the keyboard frame supports an anti-floating part which extends across the rear portions of the white keys and positioned above the white key supporting parts of the white keys so as to prevent the rear portion of the white key from floating upward when the front portion of the white key is pressed downward, wherein each key has a top surface extending between the front portion and the rear portion of the key and being disposed below the anti-floating part and above the supporting part, wherein the white keys and the black keys are arranged such that the top surfaces of the white keys below the anti-floating part are positioned higher than the top surfaces of the black keys below the anti-floating part, and wherein a gap between the top surface of the black key and the anti-floating part is greater than another gap between the top surface of the white key and the anti-floating part such that the gap is sufficient to avoid collision of the black key with the anti-floating part when the black key is pivoted.

2. The keyboard device according to claim 1, wherein the black key supporting part supports the black key at a position lower than a position at which the white key is supported by the white key supporting part so that the top surface of the white key is positioned higher than the top surface of the black key.

3. The keyboard device of claim 1:

wherein the anti-floating part is placed in contact with the white key in an ascended position where the front portion of the white key is not pressed downward, and is provided with an elastic member which elastically deforms in response to a contact pressure which is caused when the white key is pressed downward, wherein the keyboard device further comprises a pressure sensor which is mounted to the elastic member, and wherein the pressure sensor detects a change of the contact pressure while the white key is pivoted downward to thereby detect whether or not the white key is pivoted from the ascended position and to detect a pivoting degree of the white key as the white key is pivoted downward.

4. The keyboard device of claim 1:

wherein the keyboard frame supports more than one anti-floating part which extend across the rear portions of the white keys above the white key supporting parts of the white keys and also extend across the rear portions of the black keys above the black key supporting parts of the black keys so as to restrict upward floating of the rear portions of the white keys and the black keys when the front portions of the white keys and the black keys are pressed downward, wherein an anti-floating part of the white keys is mounted above the white key supporting parts and another anti-floating part of the black keys is mounted above the black key supporting parts in parallel manner such that a relative position of the anti-floating part of the white keys with reference to the white key supporting parts is identical to a relative position of the anti-floating part of the black keys with reference to the black key supporting parts, wherein the anti-floating parts are mounted to the keyboard frame by means of a restriction member which is connected to the keyboard frame and which extends over the plurality of the keys including the white keys and the black keys, wherein both the anti-floating part of the white keys and the anti-floating part of the black keys are mounted to the same restriction member, wherein the anti-floating part of the white keys are formed to cover all of the plurality of the white keys and the anti-floating part of the black keys are formed to cover all of the plurality of the black keys, and wherein the anti-floating part of the white keys are arranged discretely in a direction along which the keys are arranged so that the anti-floating part of the white keys does not interfere with the black keys.

5. The keyboard device of claim 1:

wherein the keyboard frame supports more than one anti-floating part which extend across the rear portions of the white keys above the white key supporting parts of the white keys and also extend across the rear portions of the black keys above the black key supporting parts of the black keys so as to restrict upward floating of the rear portions of the white keys and the black keys when the front portions of the white keys and the black keys are pressed downward, wherein at least one of the anti-floating part and a portion of the key contactable to the anti-floating part is formed in a circular arc shape having a center at the supporting part of the key such that a gap between the rear portions of the keys and the anti-floating part is maintained constantly while the keys are pivoted, and wherein the anti-floating part is provided separately from the supporting part of the keys.

* * * * *